United States Patent [19]

Niederer et al.

[11] 4,382,501

[45] May 10, 1983

[54] EGG ORIENTATION MEANS

[75] Inventors: Thomas O. Niederer; Lee H. Niederer, both of Titusville, N.J.

[73] Assignee: Otto Niederer Sons, Inc., Pennington, N.J.

[21] Appl. No.: 200,308

[22] Filed: Oct. 24, 1980

[51] Int. Cl.[3] ..... B65G 47/24

[52] U.S. Cl. ..... 198/384

[58] Field of Search ..... 198/384–386, 198/779; 221/173

[56] References Cited

U.S. PATENT DOCUMENTS

| | | | |
|---|---|---|---|
| 2,497,655 | 2/1950 | Bramson . | |
| 2,704,146 | 3/1955 | Reck . | |
| 2,711,813 | 6/1955 | Jordan . | |
| 2,895,589 | 7/1959 | Rostron . | |
| 2,919,787 | 1/1960 | Reck et al. . | |
| 3,075,629 | 1/1963 | Gibbs . | |
| 3,126,993 | 3/1964 | Van Der Schoot . | |
| 3,311,216 | 3/1967 | Jones . | |
| 3,370,692 | 2/1968 | Mosterd . | |
| 3,428,161 | 2/1969 | Hiederer | 198/779 |
| 3,463,292 | 8/1969 | Booij et al. . | |
| 3,592,327 | 7/1971 | Koch . | |
| 3,610,400 | 10/1971 | Burkholder . | |

*Primary Examiner*—James G. Smith
*Assistant Examiner*—Douglas D. Watts
*Attorney, Agent, or Firm*—Frederick A. Zoda; John J. Kane; Albert Sperry

[57] ABSTRACT

An egg orientation device is disclosed which is adapted to receive eggs previously arranged along the longitudinal axes thereof and to arrange those eggs with the pointed ends thereof directed as desired. The device includes a conveyor formed by a plurality of egg supports defining egg receiving recesses therebetween each having an open bottom area through which protrudes at selected locations an egg inverter device. The inverter device comprises an abutment member which includes a friction surface thereon wherein the abutment member extends upwardly into the egg receiving recess through the open bottom area thereof to contact the bottom of the shell of an egg located therein to exert a primarily tangentially force upon the shell of the egg for inversion thereof. The egg receiving recesses being preferably approximately one and one half times the length of an average egg. The egg supporting member of the conveyor preferably being continuously rotating in a common direction such that the eggs will gravitate toward the pointed end such that the pointed direction will be defined for selective inversion.

10 Claims, 5 Drawing Figures

EGG ORIENTATION MEANS

BACKGROUND OF THE INVENTION

1. Field of the Invention

The present invention deals with the field of egg handling equipment and in particular with the field of egg orientation devices. The orientation aspect novel to the present design deals with the ordering of the pointed ends of eggs which are received with the long axes thereof already previously ordered. Namely, the present invention is adapted to receive eggs having parallel or coincident long axes wherein the direction of the pointed end of the egg is random. This randomness is brought into a known relationship by the rotation of the egg support means such that the eggs will gravitate toward the pointed end within the particular recess in which they are located. Those eggs oriented in one of the two directions will selectively be capable of being inverted by the inverter means of the present invention to orient the pointed and big ends of the eggs as desired.

2. Description of the Prior Art

Prior art devices include numerous patents such as U.S. Pat. Nos. 2,497,655; 2,704,146; 2,711,813; 2,895,589; 2,919,787; 3,075,629; 3,126,993; 3,311,216; 3,370,692; 3,463,292; 3,592,327; 3,610,400; 1,394,445; 2,141,112; 2,687,802; 2,619,216; and 2,717,729.

These patents describe a variety of different means of orienting the pointed ends of eggs including abutment edges extending above the conveyor or deflection members extending downwardly from above onto the conveyor and other similar devices. None of the devices discloses a means for inverting the egg by the exertion of a primarily tangenital force from a movable member positioned below the egg supporting means of the egg conveyor.

SUMMARY OF THE INVENTION

The present invention discloses an egg orientation means for receiving eggs arranged along the long axes thereof and adapted to orient the pointed ends and big ends of the eggs as desired. The orientation means includes an egg conveyor means for transporting the eggs longitudinally therealong wherein the conveyor means includes a plurality of laterally extending egg support means preferably comprising spring means mounted around transversely extending rods. These egg support means are adapted to move longitudinally with the egg conveying means and are selectively rotatable along the laterally extending axes thereof in order to allow the eggs to gravitate toward the pointed ends thereof.

A plurality of egg receiving recesses are defined between the individual egg support means such as to include an open bottom area within each egg receiving recess. The egg receiving recesses are arranged in at least one longitudinally extending row.

The orientation means further includes a plurality of divider means which extend longitudinally along the conveyor means thereabove. The divider means themselves are actually positioned between the longitudinally extending rows of egg receiving recesses to thereby facilitate the retaining of eggs therein.

The egg orientation means further includes an egg inverter means which extends laterally under the egg conveying means and is adapted to selectively extend upwardly through the open bottom area defined by the egg receiving recesses to thereby contact and invert an egg along its major axis as desired.

The egg inverter means preferably includes an abutment means which is movably positioned to extend upward into the egg receiving recesses through the open bottom area thereof such as to contact the bottom of the shell of an egg located therein. The abutment means is also movable in a lateral direction with respect to the egg shell such as to exert a force primarily tangentially upon the shell of the egg to urge the egg to rotate about its major axis. In order to facilitate contact between the abutment means and the egg shell a friction surface is preferably defined along the portion of the abutment means which actually contacts the egg shell. This friction surface will preferably have a pre-defined coefficient of friction to control the magnitude of this tangentially directed force.

Preferably the egg inverter means will comprise a rotatably movable spiral member to facilitate the maintaining of abutment between the friction surface and the egg shell while the egg conveyor means is moving longitudinally. That is, while the conveyor means is continuously moving, the spiral member will allow contact to be maintained between the friction surface and the egg shell for a longer period of time than would be possible by a purely circular member. The egg inverter means could be only a short tab-type member and control for egg rotation could be achieved by increasing the coefficient of friction on the tab surface.

Preferably the individual egg support members will be rotating in a common direction such as to cause the eggs to gravitate toward the pointed end thereof such as to be located slightly off-center within a given egg receiving recess which is normally one and one half egg lengs wide. In this manner the placement of the egg inverter means slightly off-center will cause all those eggs with the pointed end in a given orientation to be inverted such as to have all the eggs within a given longitudinally extending row to ultimately have a common order.

The egg divider means will include any number of longitudinally extending rows such as to have a reference divider extending longitudinal along the orientation means. In this manner each egg receiving recess will have an inner divider surface and an outer divider surface wherein the inner divider surface is closest to the reference divider and the outer divider surface is farthest from the reference divider. By rotation of the egg support means the pointed end of the egg will gravitate toward either the inner or outer divider surface as above described. With this configuration, the placement of the egg inverter means slightly off-center away from the central divider, that is, closer to each outer divider surface than to the inner divider surface, will cause all those eggs having the pointed end directed outwardly or away from the reference divider to be inverted. With this configuration the ultimate orientation will be such that the pointed end of every egg will be now in abutment with the inner divider surface or be pointed toward the reference divider.

In order to assure effective control of operation of the egg inverter means an inverter control means may be included. This control means will preferably include a primary inverter drive shaft which extends laterally across and below the egg conveyor means as well as a plurality of primary gear means which are fixedly secured to this primary inverter drive shaft. Furthermore, the inverter control means preferably includes a mounting member which extends laterally across and below the egg conveyor means which is adapted to hold longitudinally extending secondary inverter drive shafts rotatably mounted therein. Each of these secondary inverter drive shafts will preferably include a secondary gear means which is fixedly secured thereto and is in a position in engagement with one of the primary gear means on the primary inverter drive shaft. Preferably an inverter drive means also is operably secured to the primary inverter drive shaft to cause rotation thereof and movement of the egg inverter means by mechanical linking between the primary and secondary drive means as well as the secondary inverter drive shafts.

The individual egg support means of the present invention preferably includes a spring means which is positioned extending about transversely oriented rods. Also in order to narrow the lateral width of a conveyor means to facilitate packing a converging divider means may be secured to the end of the conventional divider means as well as having deflector means secured thereto adjacent the outer divider surfaces and in this manner cause all eggs to be packed with a pointed downward orientation as they are discharged off the spring conveyor means.

It is an object of the present invention to provide an egg orientation means which inverts eggs selectively while located within egg receiving recesses on a continuously moving egg conveyor means.

It is an object of the present invention to provide an egg orientation means which is adapted for receiving of eggs previously arranged with long axes thereof coincident or parallel with respect to one another wherein the orientation comprises ordering of the pointed ends of the eggs.

It is an object of the present invention to provide an egg orientation means for ordering eggs located within egg receiving recesses having open bottom areas wherein the egg inversion means extends upwardly through the open bottom area from a location below the egg conveyor means.

It is an object of the present invention to provide an egg orientation means for receiving eggs arranged along the long axes thereof and adapted to orient the pointed ends of the eggs as desired which includes a plurality of egg support means which are continuously rotating to cause the eggs to gravitate toward the pointed ends thereof to facilitate orientation of those pointed ends as desired.

It is an object of the present invention to provide an egg orientation means which includes an egg inverter means extending laterally under an egg conveyor means which is adapted to selectively extend upwardly through the open bottom area in an egg receiving recess to contact and invert an egg along its major axis.

It is an object of the present invention to provide an egg orientation means including an egg inverter means having an abutment surface which is movably positioned to extend upward into an egg receiving recess through an open bottom area thereof such as to contact the egg shell and exert a primary tangential force therealong in order to minimize egg damage.

It is an object of the present invention to provide an egg orientation means which includes an inverter means having an abutment means with a friction surface along a portion thereof which facilitates direct contact between the abutment means and the shell to control the tangentially directed force thereof by the pre-determined coefficient of friction of the friction surface itself.

It is an object of the present invention to provide an egg orientation means including an egg inverter means having a spiral member which is rotatably movable to facilitate contact of an abutment area thereof with respect to an egg located on a continuously moving conveyor.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

and

Figure 4:
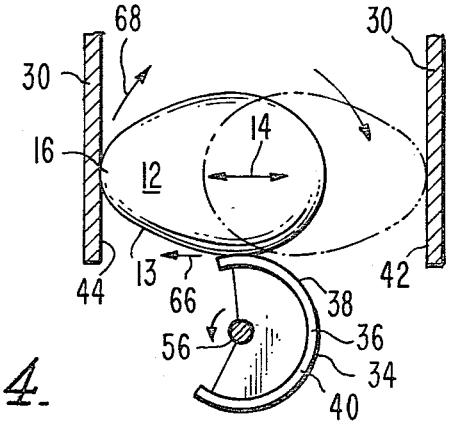
FIG. 4 is an end view of the embodiment illustrated in FIG. 3 showing the egg immediately prior to inversion thereof.
Figure 5:
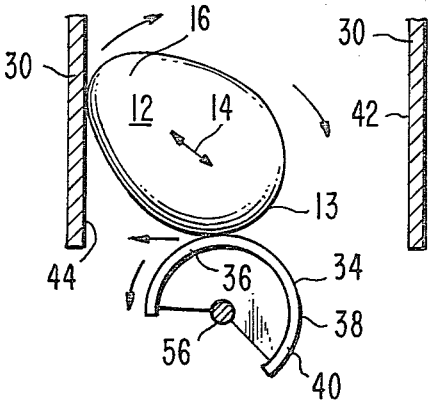

FIG. 5 is an illustration of the embodiment as shown in FIG. 4 wherein the egg is shown during inversion thereof.

DETAILED DESCRIPTION OF THE PREFERRED EMBODIMENT

Figure 1:
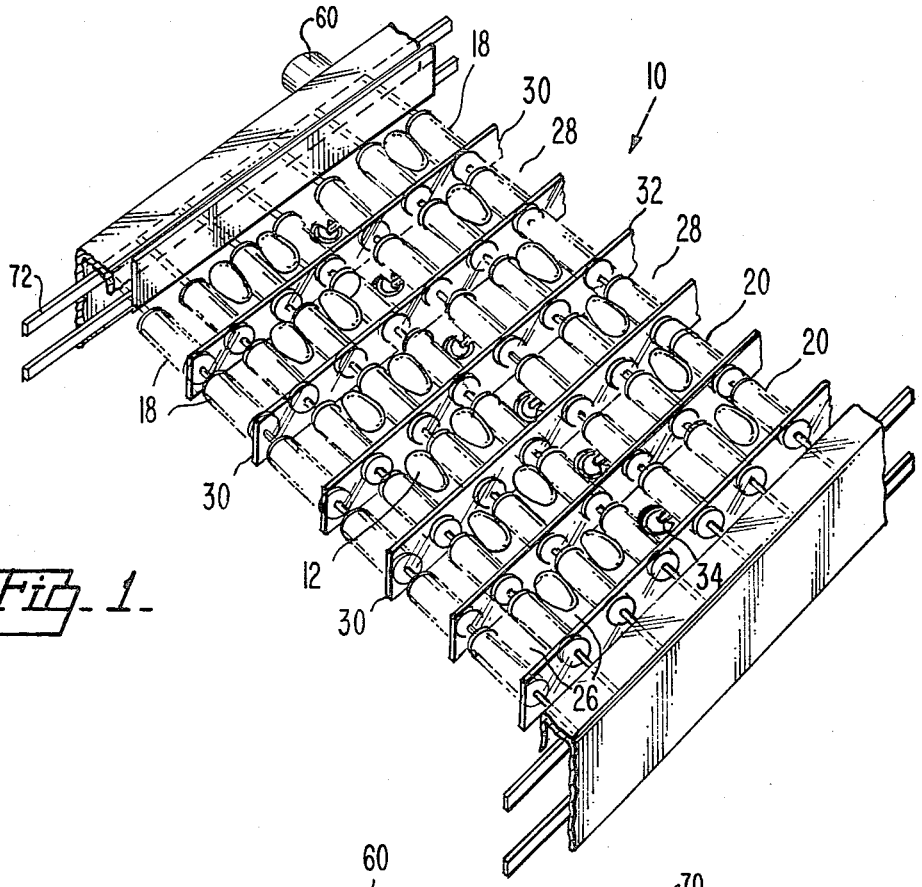
FIG. 1 is a perspective view of an embodiment of the egg orientation means of the present invention.
Figure 2:
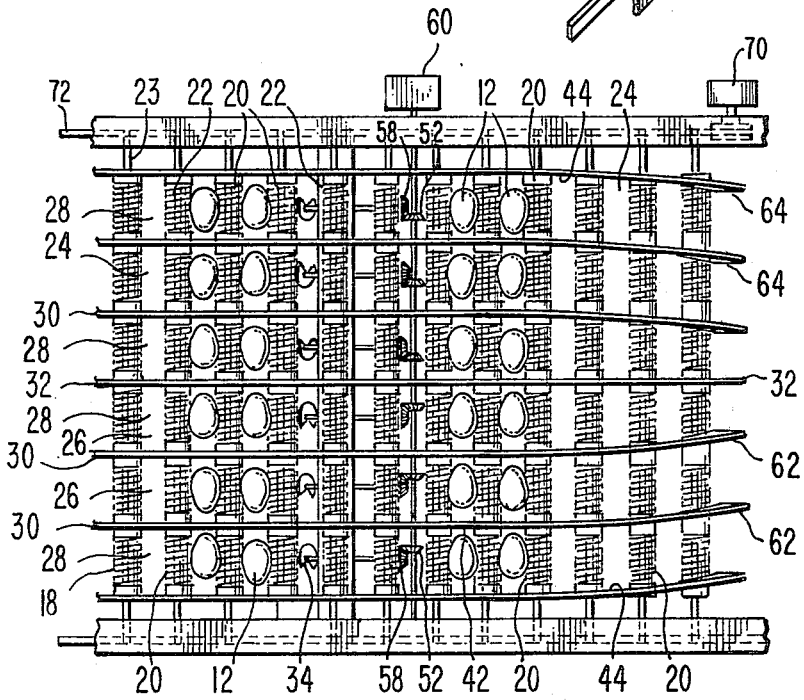
FIG. 2 is a top plan view of the embodiment illustrated in FIG. 1.

The egg orientation means 10 of the present invention provides a device for receiving eggs arranged along the long axes thereof which is adapted to orient the eggs with the pointed ends thereof as desired. The eggs 12 as shown in FIGS. 1 and 2 are received with the long axis 14 of the egg shell 13 oriented transversely with respect to the direction of movement of the egg conveyor means 18. That is, the pointed ends of the eggs 16 extend laterally in one direction and the big ends extend laterally in the opposite direction. However, the particularly chosen orientation of the pointed ends 16 is random. The present invention deals with the problem of orienting these pointed ends as desired.

The orientation means 10 includes an egg support means 20 which may preferably comprise a plurality of springs 22 extending laterally with respect to the direction of movement of the conveyor 18. The springs 22 are preferably mounted upon transversely extending rods 23. The support means 20 defines a plurality of egg receiving recesses 24 arranged in an array of longitudinal rows 28 thereof. Preferably there will be six such longitudinal rows 28 but the present orientation means would function equally well with only one longitudinal row. The rods are moved in the conveying direction by a drive means 70 powering a chain 72 which is secured with respect to each rod. For support the chain may extend along each opposite side of the conveyor and is powered preferably on one side thereof.

Each of the egg receiving recesses 24 is defined by two adjacently positioned egg support means 20. In this fashion the egg support means 20 will also define an open bottom area 26 within each egg receiving recess 24. Each longitudinal row 28 is separated from the adjacent longitudinally extending row by a divider means 30. With any number of longitudinal rows a reference divider member 32 will be included and with this embodiment a reference divider 32 is located in the center of six longitudinal rows 28.

An essential novel aspect of the present invention is the egg inverter means 34 which is adapted to selectively extend upwardly through the open bottom area 26 of the egg conveyor means 18. This egg inverter means 34 will include an abutment means 36 adapted to contact an egg positioned within one of the egg receiving recesses 24. In particular the abutment means 36 will be located slightly off-center in the egg receiving recess 24, that is, at a position slightly outward from the recess. This configuration is necessary in order to assure that the only eggs which will be inverted are those which have the pointed ends extending outwardly away from the reference divider 32 as will be described herebelow.

Each abutment means 36 of each egg inverter means 34 will preferably include a friction surface 38 in order to control the coefficient of friction between the abutment means 36 and the shell 13 of the individual eggs 12. In order to maintain contact between the friction surface 38 and an egg located upon a moving conveyor it is preferable to configure the abutment means 36 as a rotatably movable spiral member 40. By proper coordination between the speed of rotation of member 40 and the longitudinal distance between the egg receiving recesses 24 continuous contact can be maintained between friction surface 38 and the egg shell 13. Alternatively if the surface 38 of abutment means 36 has a large coefficient of friction with respect to an egg shell, the abutment means 36 could merely be a tab only contacting the egg shell momentarily.

Each egg receiving recess wall includes an inner dividing surface 42 between that recess and the reference divider as well as an outer dividing surface 44 which is on the outboard side of the recess from the reference divider 32. Conventional means is provided to continuously rotate the egg support means 20. Such rotation is well known in the art to cause gravitation of eggs 12 toward the pointed ends 16 thereof. In other words as the eggs are traveling along the conveyor and are each located within one of the egg receiving recesses 24 and the support means 20 is continuously rotated, the eggs will be caused to gravitate such that the pointed ends thereof contact either the inner divider surface 42 or the outer divider surface 44. Also preferably the distance between surfaces 42 and 44 will be approximately one and one half times the average length of an egg. Therefore, by positioning the egg inverter means 34 not in the center directly below an egg receiving recess 24, but slightly toward the outer divider surface 44, a means will be defined for inverting only those eggs with the pointed ends 16 thereof facing away from the reference divider 32.

It is preferable to provide an inverted control means 48 for operably controlling the coordination of movement between the egg inverter means 34 and each associated egg receiving means 24. This inverted control means preferably includes a primary inverter drive shaft extending transversely across the egg conveyor means 18 at a location therebelow. This drive shaft 50 is preferably powered by an inverted drive means 60. A plurality of primary gear means 52 are positioned along the primary inverter drive shaft and are fixedly secured with respect thereto. A plurality of secondary inverter drive shafts 56 are located extending through a mounting member 54 positioned below the conveying means 18. A secondary gear means 58 is located fixedly secured with respect to each secondary inverter drive shaft in a position in engagement with one of the primary gear means 52 on the primary inverter drive shaft 50. Also, each secondary inverter drive shaft 56 is fixedly secured with respect to one of the rotatably movable spiral members 40. With this configuration, the inverter drive means 60 will cause rotation of the primary inverter drive shaft 50. Each primary gear means 52 will similarly rotate and if configured as a beveled gear complementary to the secondary gear means 58 will cause similar rotation of the secondary inverter drive shafts 56. In this manner coordinated rotational movement of the egg inverter means 34 associated with each individual recess 24 will be achieved.

As shown in FIG. 2, once the eggs have passed the location of the inverter means all of the pointed edges will be oriented facing toward the reference divider 32. Attached to the end of the divider means may be extensions thereof defined as converging divider means 62 for narrowing down the lateral width of the conveyor to facilitate releasing of the eggs for packing therebelow as desired. This packing is facilitated by the inclusion of deflector means 64 each being secured with respect to the outer divider surface 44 of at least some of the converging dividers 62 in such a fashion as to delay movement of the big end of the egg and facilitate packing of the eggs with the pointed ends thereof directed downwardly.

In operation, this embodiment of the egg conveyor means 18 will receive a plurality of eggs as shown in FIG. 2 all located in six wide arrays of recesses with the long axes of 14 of these eggs arranged coincident with respect to one another. However, the direction of the pointed ends 16 of the egg will be at random. Therefore, it will be necessary to orient these eggs as desired which as shown in the embodiment in FIG. 2 would be such that all of the pointed ends extend toward the reference divider 32. To achieve this orientation it is necessary to flip over all those eggs which have the pointed ends thereof facing outwardly. This is achieved by rotation of the individual egg support means 20 in a common direction such that the eggs will gravitate with the pointed ends thereof contacting one or the other of the walls of the divider helping to define each egg receiving recess. By locating of the egg inverter means closer to the outer divider surface 44 than the inner divider surface 42 flipping of the eggs with the pointed ends extending outwardly will be achieved whereas prevention of flipping of eggs with the pointed ends thereof extending inwardly will be achieved.

Figure 3:
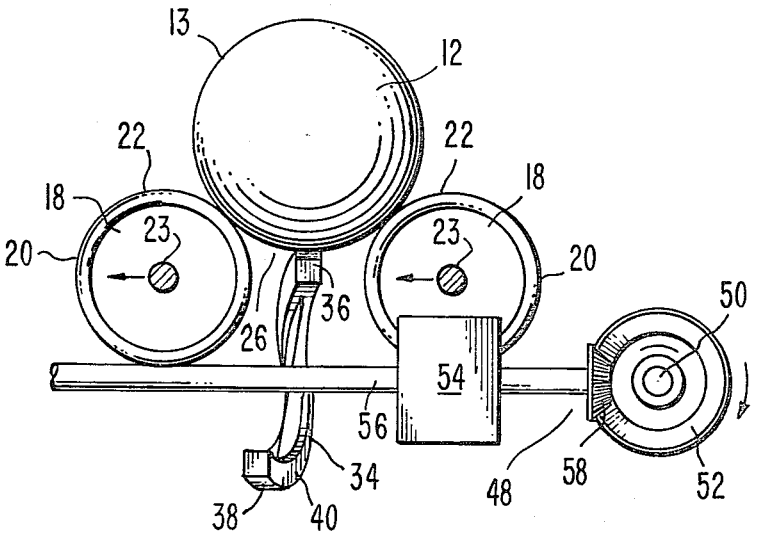
FIG. 3 is a side view of an embodiment of the egg inverter means of the present invention.

The actual flipping movement is best shown in FIGS. 3 through 5. FIG. 3 shows the initial contact between the friction surface 38 and the egg shell 13. This configuration is also shown in FIG. 4 as the tangentially directed force 66 and is utilized to minimize the chances of egg shell damage. Since the pointed end 16 of the egg is already in contact with the divider means 30 the only resulting possible movement of the egg is in an upward direction as shown by arrow 68. The egg will then tend to rotate as further shown in FIG. 5 about the long axis 14 thereof. Upon completely inverting 180° the egg will now be caused to gravitate such that the pointed end thereof contacts the inner divider surface 42 and orientation will be achieved. The lateral width of the eggs can now be narrowed by the converging divider means 62, and the big ends thereof can be resiliently retained in an upwardly directed orientation by contact with the deflector means 64 positioned on the outer divider surface 44 of these converging dividers 62.

In this manner a novel egg inverter means is disclosed which utilizes a member moving upwardly from beneath an egg conveying means.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

We claim:

1. An egg orientation means, for receiving eggs adapted to orient the pointed ends of the eggs as desired, which comprises:

(a) an egg conveyor means for transporting eggs longitudinally therealong, with the major axis thereof extending laterally and horizontally with respect to said egg conveyor means, said conveyor means including a plurality of laterally extending egg support means adapted to move longitudinally with said egg conveyor means, each said egg support means being selectively rotatable along the laterally extending axis thereof, said egg support means defining at least one egg receiving recess therebetween including an open bottom area therein defined by said laterally extending egg support means being arranged in at least one longitudinally extending row;

(b) a plurality of divider means extending longitudinally along and above said egg conveyor means between said longitudinally extending rows of egg receiving recesses to facilitate retaining of eggs therein; and (c) an egg inverter means extending laterally under said egg conveyor means and adapted to selectively extend upwardly through said open bottom area into said egg receiving recesses to contact and invert an egg along the major axis thereof to orient the point thereof to extend in the direction opposite to its direction prior to inversion and with the major axis thereof remaining in a lateral and horizontal orientation with respect to said egg conveyor means, said egg inverter means including:

(1) an abutment means movably positioned to extend upward into said egg receiving recess through said open bottom area thereof into contact with the bottom of the shell of an egg located therein, said abutment means being movable laterally with respect thereto to exert a force upon the shell of the eggs to urge the eggs, upon contact with the pointed end thereof with the adjacent divider means, to invert along the major axis thereof with the pointed end in the opposite orientation than previously; and (2) a friction surface along the portion of said abutment means which directly contacts the shell of the egg to be inverted, said friction surface having a pre-defined coefficient of friction to control the magnitude of force being exerted upon the shell of the egg to be inverted.

2. The orientation means as defined in claim 1 wherein said friction surface and said abutment means of said egg inverter means are adapted to merely contact the shell of an egg without exerting any uplifting vertical force thereon to exert only a lateral tangential force thereupon for inverting.

3. The orientation means as defined in claim 1 wherein said egg inverter means comprises a rotatably movable spiral member to facilitate the maintaining of abutment between said friction surface and the egg shell while said egg conveyor means is moving longitudinally.

4. The orientation means as defined in claim 1 wherein said abutment means of said egg inverter means is located away from the center of said egg receiving recess in order to contact and invert only those eggs positioned off center in one pre-defined direction therein.

5. The orientation means as defined in claim 1 wherein said egg inverter means includes an inverter control means comprising:

(a) a primary inverter drive shaft extending laterally across and below said egg conveyor means;

(b) a plurality of primary gear means positioned fixedly secured therealong;

(c) a mounting member extending laterally across and below said egg conveyor means;

(d) a plurality of secondary inverter drive shafts each being fixedly secured with respect to one of said egg inverter means and being rotatably mounted through said mounting member;

(e) a plurality of secondary gear means each being fixedly secured to one of said secondary inverter drive shafts in a position in engagement with one of said primary gear means on said primary inverter drive shafts; and (f) an inverter drive means operably secured to said primary inverter drive shaft to cause rotation thereof and, through said primary and secondary drive means and said secondary inverter drive shafts, rotation also of said egg inverter means.

6. The orientation means as defined in claim 1 wherein said friction surface and said abutment means of said egg inverter means are adapted to contact and lift the shell of an egg by exerting an upwardly and tangentially directed force for inverting of eggs.

7. The orientation means as defined in claim 1 wherein said egg receiving recesses are approximately one and one half times the length of an average egg.

8. The orientation means as defined in claim 1 wherein said egg conveyor means defines six longitudinally extending rows of egg receiving recesses.

9. The orientation means as defined in claim 1 wherein said egg support means comprises a variety of spring means extending laterally across said egg conveyor means.

10. The orientation means as defined in claim 1 further including a plurality of converging divider means attached to the ends of said divider means above said conveyor means to move the oriented eggs closer with respect to one another to facilitate packing.

* * * * *